US005655382A

United States Patent [19]

Chen

[11] Patent Number: 5,655,382

[45] Date of Patent: Aug. 12, 1997

[54] WEATHER, DUST, AND IMPACT PROTECTIVE SHIELDING DEVICE

[76] Inventor: Tze Li Chen, P.O. Box 82-144, Taipei, Taiwan

[21] Appl. No.: 597,943

[22] Filed: Feb. 7, 1996

[51] Int. Cl.[6] ..... F25D 23/00

[52] U.S. Cl. ..... 62/262; 52/3; 53/472; 206/216; 206/320; 206/321; 206/586

[58] Field of Search ..... 62/262, 263; 52/3; 53/139.5, 139.6, 139.7, 472; 206/216, 320, 321, 586

[56] References Cited

U.S. PATENT DOCUMENTS

| | | | |
|---|---|---|---|
| 2,874,551 | 2/1959 | Bradbury et al. | 62/262 |
| 2,892,424 | 6/1959 | Mondi | 52/3 |
| 2,901,989 | 9/1959 | Mondi | 62/262 |
| 2,905,454 | 9/1959 | Wood | 62/262 |
| 2,941,380 | 6/1960 | Garred | 52/3 |
| 3,011,424 | 12/1961 | Kohnen | 454/204 |
| 3,379,481 | 4/1968 | Fisher | 312/100 |
| 4,730,423 | 3/1988 | Hughes | 52/173 R |
| 5,277,310 | 1/1994 | Mertz | 206/320 |

*Primary Examiner*—William E. Tapolcai
*Attorney, Agent, or Firm*—Alfred Lei

[57] ABSTRACT

A weather, dust, and impact protective shielding device which includes a flexible shielding plate made of flat, rectangular shape having a plurality of mounting holes for fastening to respective screw holes on the top or bottom side of an air conditioner by screws, four corner notches in the four corners thereof, and four tracks at four sides between each two corner notches, the tracks being bendable so that they can be bent inwards and covered over a part of the periphery of the air conditioner when the flexible shielding plate is fixed; and four sealing blocks for fastening to the shield plate to seal up the corner notches respectively.

7 Claims, 5 Drawing Sheets

WEATHER, DUST, AND IMPACT PROTECTIVE SHIELDING DEVICE

BACKGROUND OF THE INVENTION

1. Field of the Invention

This invention relates to shielding devices, and relates more particularly to such a shielding device which can be conveniently fastened to an object for example an air conditioner, to protect it against weather, dust, and impact.

2. Description of the Prior Art

When packing an air conditioner in a carton, shock absorbing protective bars 41 are respectively fastened to the top and bottom sides of the air conditioner, and then two cardboards or corrugated boards 42 are respectively attached to the shock absorbing protective bars 41 at the top and bottom sides of the air conditioner. This packing method has drawbacks. Because the shock absorbing protective bars 41 and the cardboards 42 are not reusable, this packing method is not economic. Another drawback of this packing method is that the shock absorbing protective bars 41 will cause environmental pollutions when disposed of because they are made from foamed plastics. Furthermore, because the air conditioner is heavy, it is difficult to attach the shock absorbing protective bars 41 to the air conditioner when the air conditioner is put in the carton.

SUMMARY OF THE INVENTION

This invention relates to a shielding device which can be conveniently fastened to an object for example an air conditioner, to protect it against weather, dust, and impact.

It is one object to provide a shielding device which effectively protects the object, to which the device is installed, against weather and dust. It is another object of the present invention to provide a weather, dust, and impact protective shielding device which effectively protects the object, to which the device is installed, against impact. It is still another object of the present invention to provide a weather, dust, and impact protective shielding device which can be conveniently fastened to the object to be protected.

According to one aspect of the present invention, the weather, dust, and impact protective shielding device comprises a flexible shielding plate made of flat, rectangular shape having a plurality of mounting holes for fastening to respective screw holes on the top or bottom side of an air conditioner by screws, four corner notches in the four corners thereof, and four tracks at four sides between each two corner notches, the tracks being bendable so that they can be bent inwards and covered over a part of the periphery of the air conditioner when the flexible shielding plate is fixed; and four sealing blocks for fastening to the shield plate to seal up the corner notches respectively. According to another aspect of the present invention, each of the sealing blocks has a tongue, which is forced into engagement with two adjacent tracks when installed.

DETAILED DESCRIPTION OF THE PREFERRED EMBODIMENT

Figure 1:
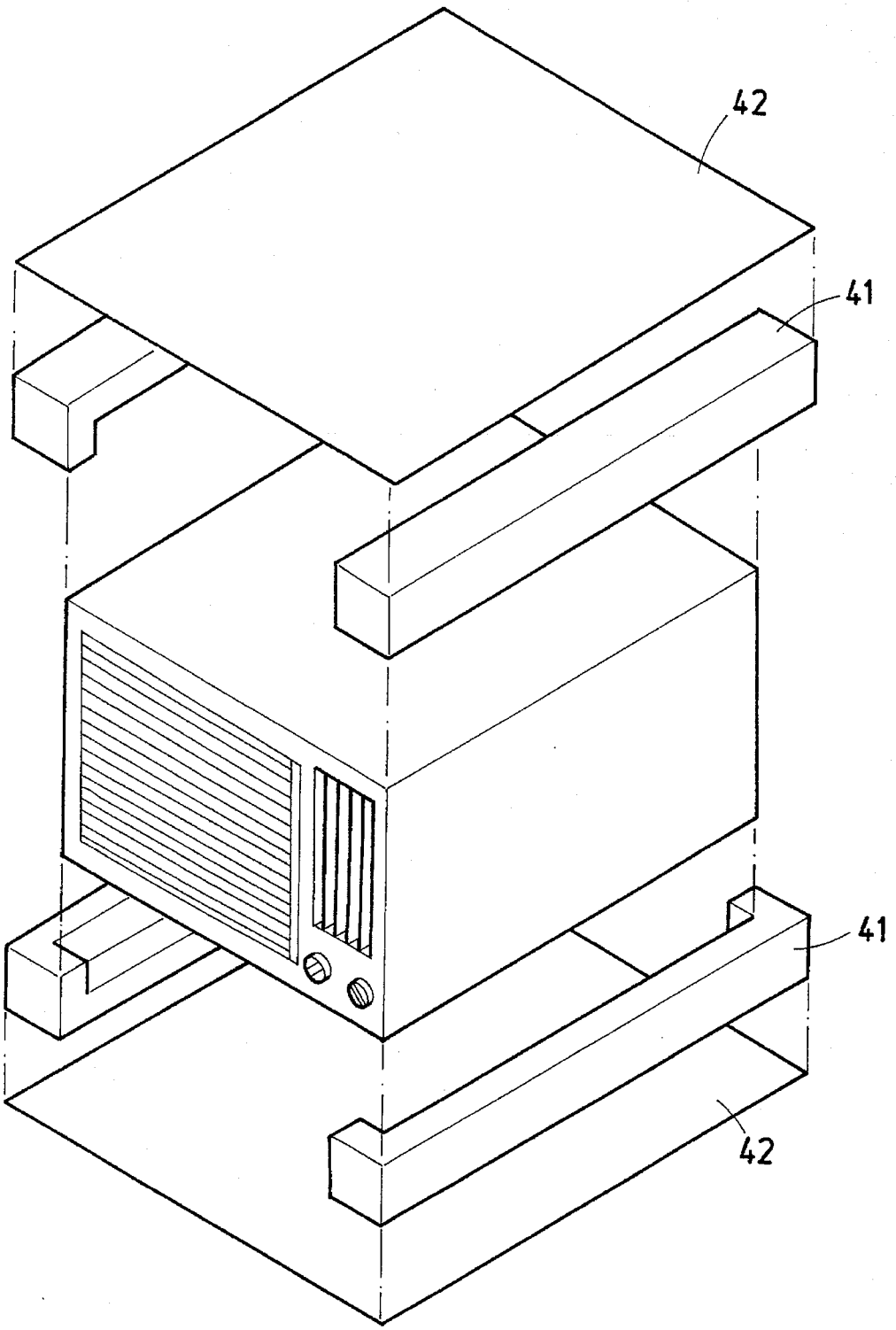
PRIOR ART FIG. 1
FIG. 1 shows an air conditioner protective shielding device according to the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
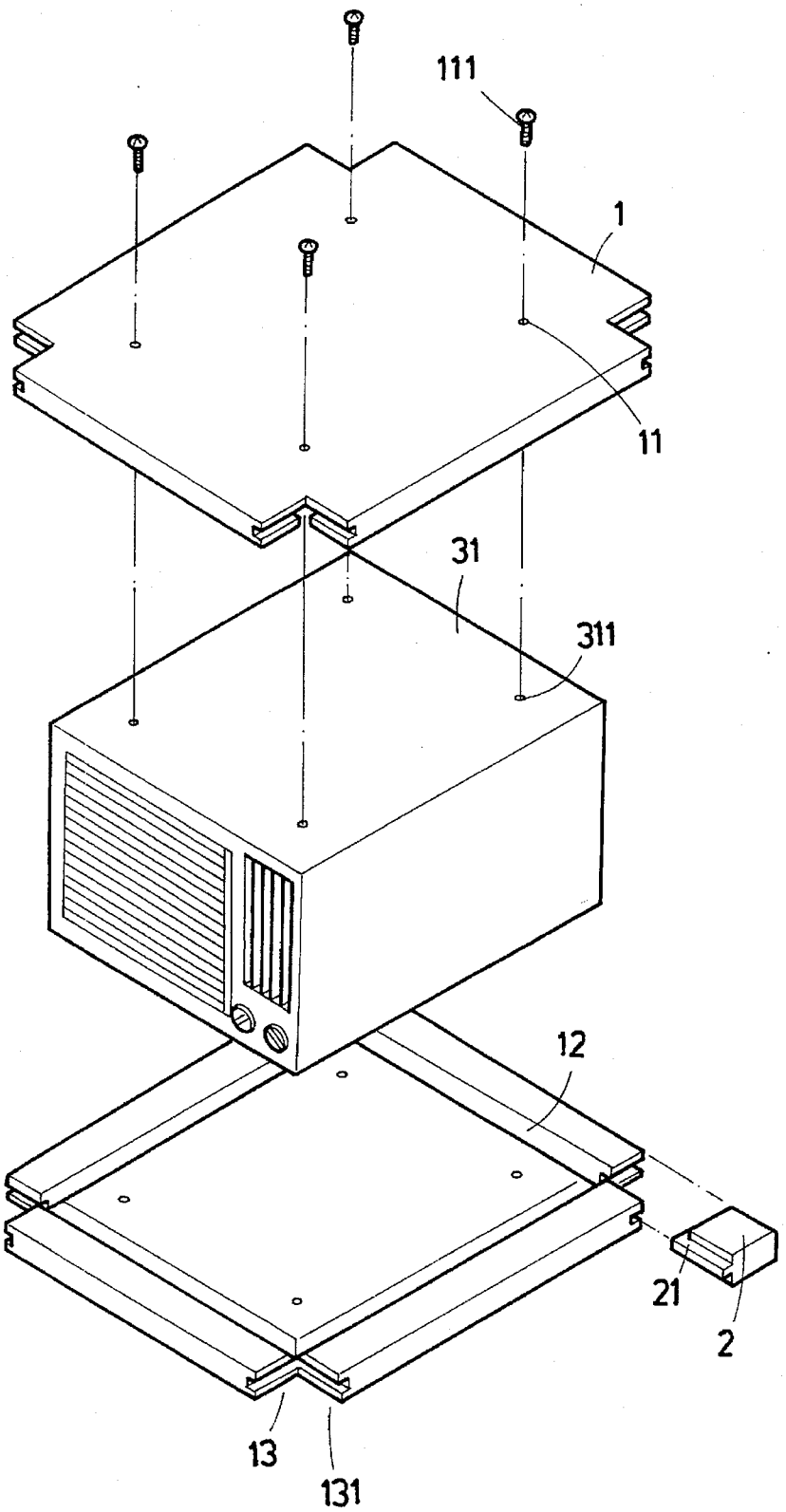
FIG. 2 is an exploded view of the weather, dust, and impact protective shielding device according to the present invention.
Figure 3:
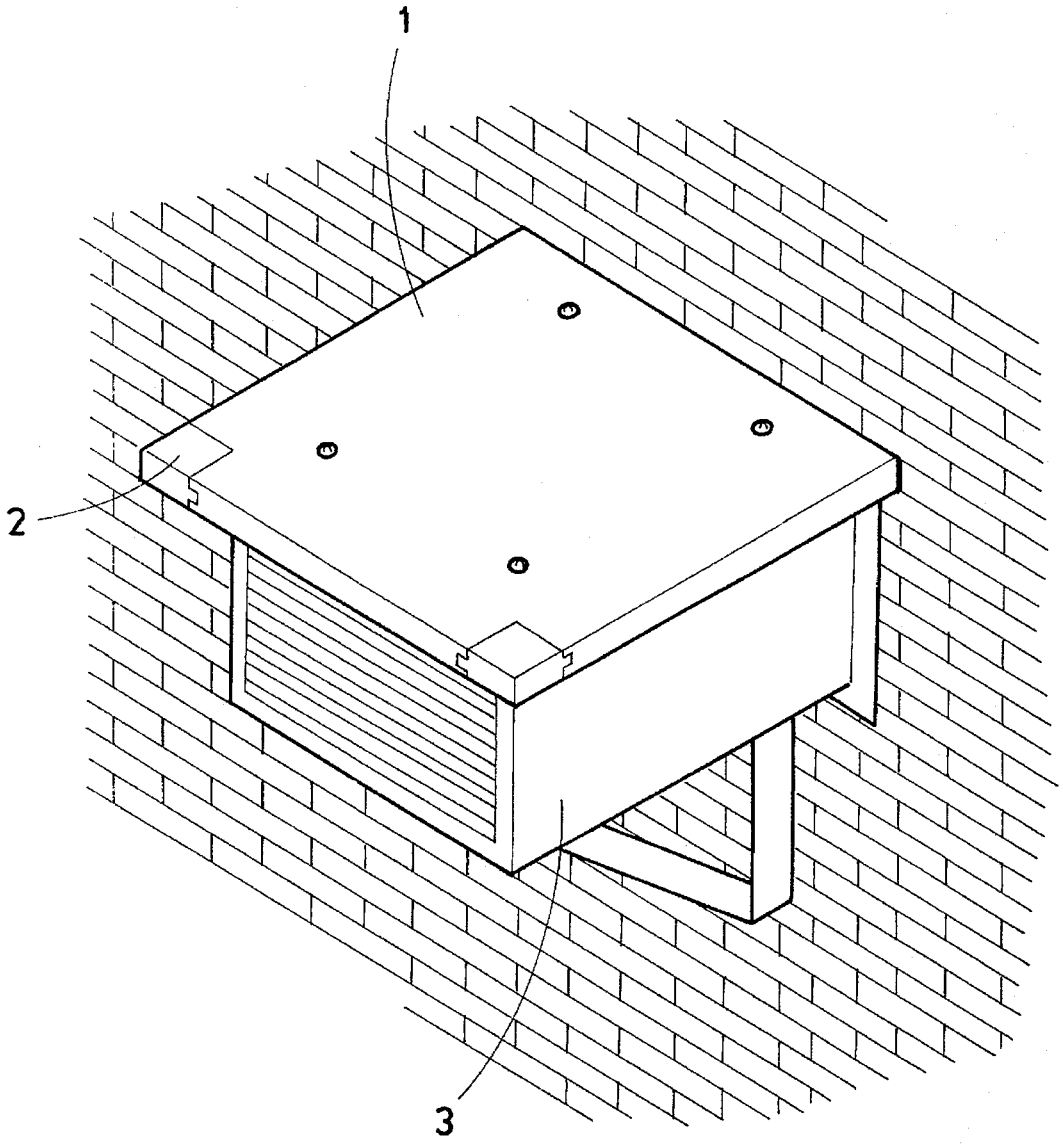
FIG. 3 is an applied view of the present invention, showing the weather, dust, and impact protective shielding device fastened to an air conditioner installed outdoors and closely attached to the wall.
Figure 4:
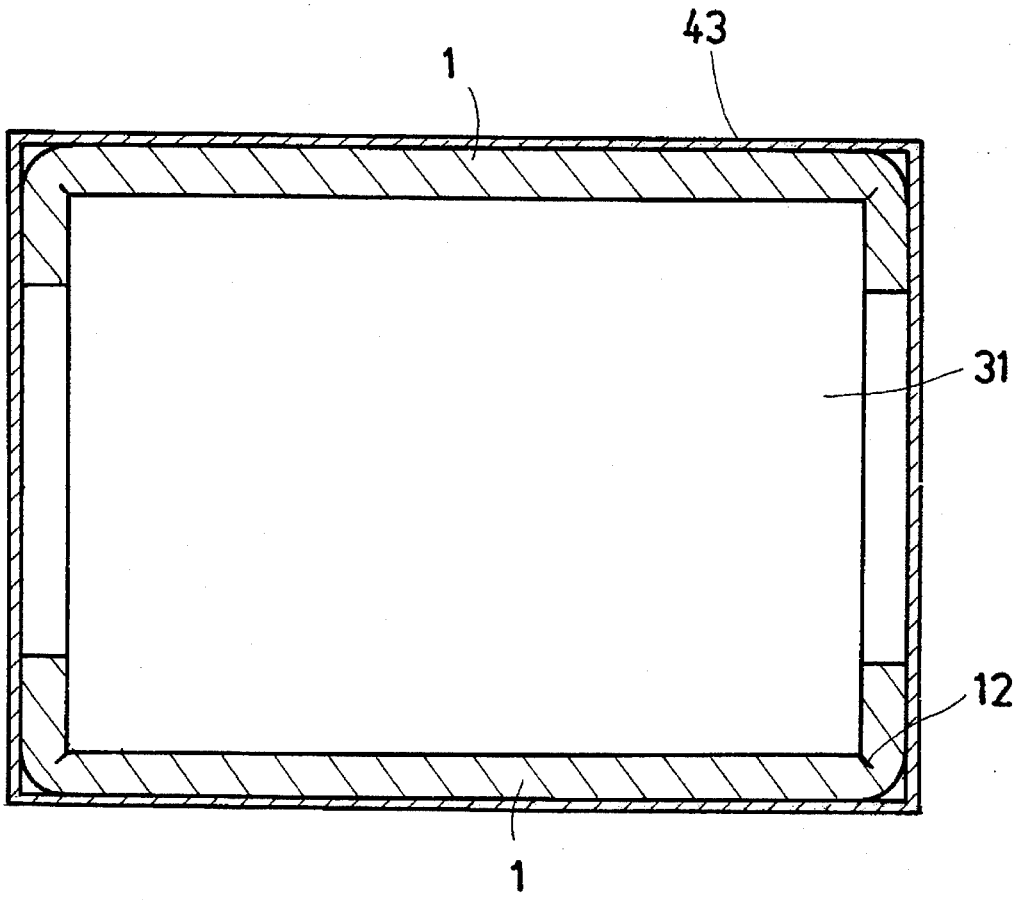
FIG. 4 is a cross sectional view showing the weather, dust, and impact protective shielding device fastened to an air conditioner packed in a carton according to the present invention.
Figure 5:
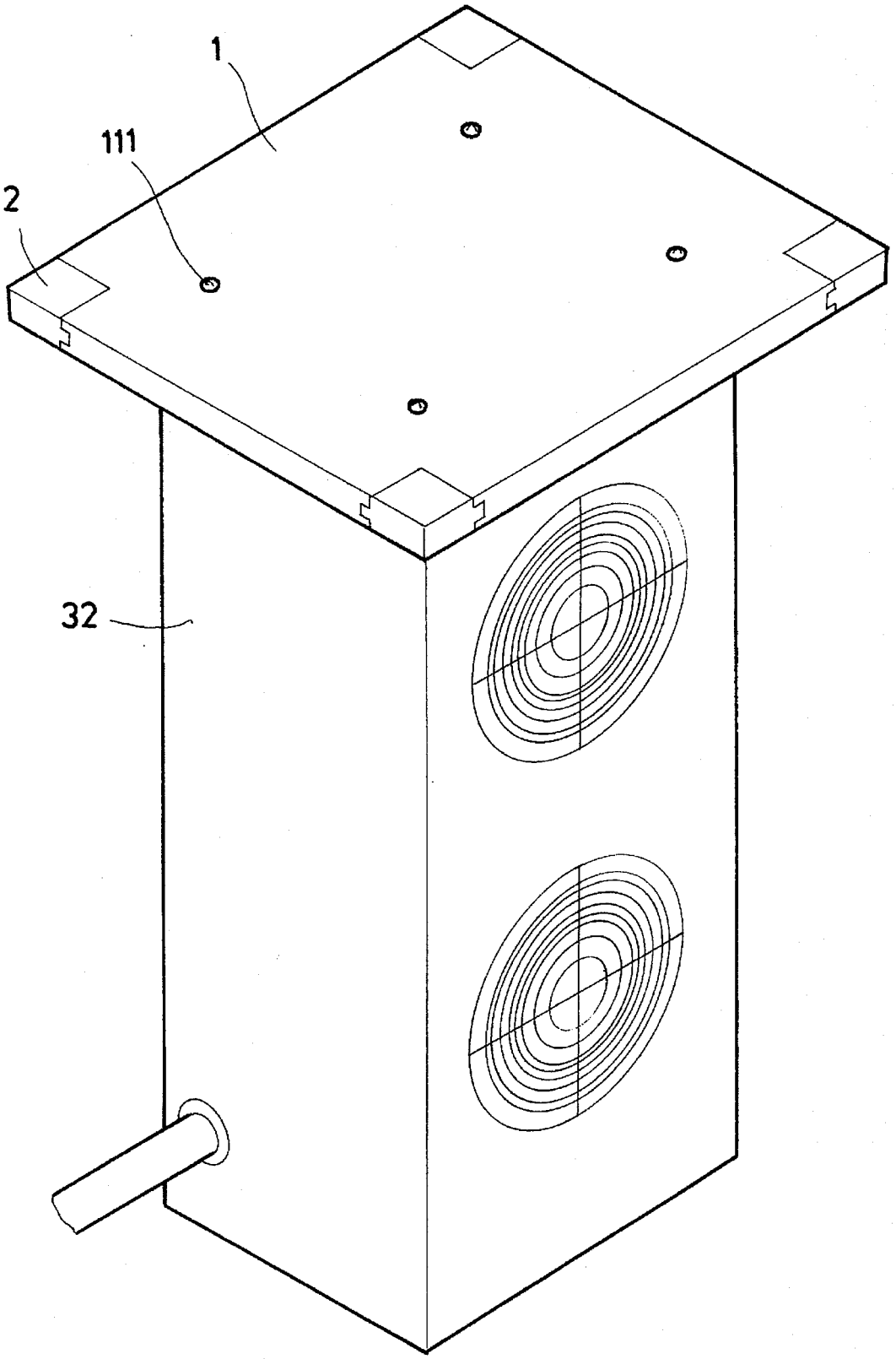
FIG. 5 is another installed view of the present invention, showing the weather, dust, and impact protective shielding device fastened to the outdoor mainframe of a separated air conditioning system, and sealing blocks fastened to the four corner notches of the flexible shielding plate.

Referring to FIGS. 2, 3, and 4, a shielding device in accordance with the present invention is generally comprised of a flexible shielding plate 1, and a plurality of sealing blocks 2. The flexible shielding plate 1 is made of flat, rectangular shape having a plurality of mounting holes 11 for fastening to respective screw holes 311 on the top (bottom) side of an air conditioner 31 by screws 111, four corner notches 13 in the four comers, and four tracks 131 at four sides between each two corner notches 13. The size of the corner notches 13 is made subject to the size of the air conditioner 31 to be protected, i.e. the corner notches 13 are disposed out of the respective corners of the top (bottom) side of the air conditioner 31 so that the tracks 131 can be respectively bent inwards and covered over a part of the periphery of the air conditioner 31. When the flexible shielding plate 1 is fixed to the air conditioner 31, the four tracks 131 are respectively bent inwards and closely attached to the periphery of the air conditioner 31, so that when the air conditioner 31 is put in the carton 43 (see FIG. 4), the tracks 131 protect the air conditioner 31 against impact. The sealing blocks 2 fit the corner notches 13 respectively, each having a flange 21. When one sealing block 2 is inserted into one corner notch 13, the flange 21 is forced into engagement with the two adjacent tracks 131 (see FIG. 3). Furthermore, fastening means such as screws, bonding agent, etc. may be used to fixedly secure the sealing blocks 2 to the shielding plate 1.

Referring to FIGS. 2 and 4 again, two shielding plates 1 can be used and fastened to the top and bottom sides of the air conditioner 31 to protect it when packed in a carton 43.

Referring to FIG. 3, one track 131 may be cut off so that the cut side of the flexible shielding plate 1 can be closely attached to the wall.

FIG. 4 shows the flexible shielding plate 1 fixed to the top side of the outdoor mainframe 32 of a separated air conditioning system, and the four sealing blocks 2 are respectively fastened to the four corners of the flexible shielding plate 1.

While only one embodiment of the present invention has been shown and described, it will be understood that various modifications and changes could be made without departing from the spirit and scope of the invention disclosed. For example, the tracks 131 of the flexible shielding plate 1 may be made corrugated so as to effectively protect the air conditioner against impact when bent inwards and covered over a part of the periphery of the air conditioner; cut grooves may be made on the flexible shielding plate 1 along the tracks 131, enabling the tracks 131 to be conveniently bent inwards.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A weather, dust, and impact protective shielding device comprising:

a flexible shielding plate made of flat, rectangular shape having a plurality of mounting holes for fastening to respective screw holes on the top or bottom side of an air conditioner by screws, four corner notches in the four corners thereof, and four tracks at four sides between each two corner notches, said tracks being bendable so that they can be bent inwards and covered over a part of the periphery of the air conditioner when said flexible shielding plate is fixed; and four sealing blocks for fastening to said shield plate to seal up said corner notches respectively.

2. The weather, dust, and impact protective shielding device as claimed in claim 1 wherein each sealing block has a tongue, which is forced into engagement with two adjacent tracks when installed.

3. The weather, dust, and impact protective shielding device as claimed in claim 1 wherein cut grooves are made on said flexible shielding plate along tracks, enabling said tracks to be bent inwards.

4. The weather, dust, and impact protective shielding device as claimed in claim 1 wherein said sealing blocks fit the shape of said corner notches.

5. The weather and dust protective shielding device as claimed in claim 1 wherein said sealing blocks are fixed secured to said flexible shielding plate by fastening means after installation.

6. The weather, dust, and impact protective shielding device as claimed in claim 1 wherein the corner notches of said flexible shielding plate are disposed out of the respective corners of the top or bottom side of the air conditioner so that said tracks can be respectively bent inwards and covered over a part of the periphery of the air conditioner.

7. The weather, dust, and impact protective shielding device as claimed in claim 1 wherein said tracks of said flexible shielding plate are respectively made corrugated.

* * * * *